US005152579A

United States Patent [19]

Bishai

[11] Patent Number: 5,152,579

[45] Date of Patent: Oct. 6, 1992

[54] PUMPING SYSTEM FOR THE BACK SUPPORT OF A SEAT

[75] Inventor: Macram N. Bishai, Windham, N.H.

[73] Assignee: McCord Winn Textron Inc., Switzerland

[21] Appl. No.: 552,473

[22] Filed: Jul. 16, 1990

Related U.S. Application Data

[63] Continuation-in-part of Ser. No. 338,577, Apr. 17, 1989, abandoned.

[51] Int. Cl.[5] ..... A47C 7/46

[52] U.S. Cl. ..... 297/284.6; 297/DIG. 3

[58] Field of Search ..... 297/284, DIG. 3, 284 E

[56] References Cited

U.S. PATENT DOCUMENTS 4,114,214 9/1978 Von Heck ..... 297/284
4,707,027 11/1987 Horvath et al. ..... 297/284
4,792,186 12/1988 Benjamin et al. ..... 297/284
4,915,124 4/1990 Sember ..... 297/DIG. 3 X

FOREIGN PATENT DOCUMENTS 60-45438 3/1985 Japan ..... 297/284

*Primary Examiner*—Gerald A. Michalesky

[57] ABSTRACT

A low pressure pumping system for power inflating and power bleeding the lumbar support of a vehicular seat including a low pressure air cell mounted in the back support. A two-position pneumatic switch serves to selectively alternately reverse a motor and pump to inflate the air cell to a predetermined capacity of less than 5 p.s.i., and to deflate the air cell through a bleed valve. The two-position pneumatic switch includes a double pole, double throw switch and a slide valve which is positioned open when the air cell is inflated. The motor is sized to stall when the predetermined capacity is attained to prevent over inflation of the air cell.

5 Claims, 4 Drawing Sheets

PUMPING SYSTEM FOR THE BACK SUPPORT OF A SEAT

This application is a continuation in part of application Ser. No. 338,577, filed Apr. 17, 1989, now abandoned.

TECHNICAL FIELD

This invention relates generally to hand operated pumping systems for the back support of a seat, such as vehicle seats, and, more particularly, to such a system of a low pressure type which do not include pressure limit switches for limiting the discharge pressure from an electric motor powered inflation pump.

BACKGROUND ART

Vehicle seats tend to become uncomfortable when the driver or passenger remains in a seated position for a long period of time. The primary area of discomfort is in the lumbar or lower back region.

Typically, while there are provisions for horizontal and tilting adjustments of vehicle seats, the selected contour of the typical seat for the average size occupant does not conform to all body shapes. Hence, it is desirable to provide means for adjusting the contour of the back support of the seat.

Various arrangements have been used satisfactorily in the past to control the pressure in back and/or seat portions of a vehicle seat. For example, see the Switch and Valve Assembly in Manning et al U.S. Pat. No. 4,633,763, wherein a push button and associated stem serve to partially open a normally closed valve to bleed off fluid under pressure from a lumbar area bladder when the push button is partially depressed, and to close a switch and actuate a pump to inflate the bladder when the push button is fully depressed.

Von Heck U.S. Pat. No. 4,114,214 includes a seat filled with expanded polystyrene micro-bearings and a switch actuated pump system which reverses to either pump up or pump down a seat cushion. A second switch is operated in conjunction with the pump reversing switch to control a solenoid valve.

Imaoka et al U.S. Pat. No. 4,722,550 discloses a pump up system which changes the hardness of the seat or back portions in response to outputs from detecting means for detecting running conditions of the motor vehicle.

Von Heck U.S. Pat. No. 3,608,961 illustrates and describes a seat cushion filled with a plurality of plastic beadlike material deformable from a generally spherical shape into a multifacet structure as a result of seat pressure control with a vacuum pump and a simple valve.

Vanderbilt et al U.S. Pat. No. 3,326,601 describes an inflatable seat back which is pumped up by a non reversible air pump and then vented to the atmosphere by virtue of the operator pushing against the seat.

Horvath et al U.S. Pat. No. 4,707,027 discloses a vehicle seat having a pneumatic lumbar selectively connected with a reversible pump via a solenoid valve. When it is desired to power down the air from the lumbar bladder, a switch is actuated to open the solenoid valve and simultaneously start the reversible motor in an opposite direction via a relay and a contact.

DISCLOSURE OF THE INVENTION

Accordingly, a general object of the invention is to provide an improved pumping system for the back support of a seat which may be powered up and powered down.

Another object of the invention is to provide an improved low pressure pumping system for powering an air cell mounted in a vehicle seat back support, which is simple in construction, can be manufactured at low cost, and is efficient in operation.

A further object of the invention is to provide a reversible low pressure pumping system for controlling a lumbar support in a vehicle seat, including a pneumatic switch for reversing a motor and pump to alternately inflate and deflate an air cell, and a bleed or exhaust valve.

A still further object of the present invention is to provide a low pressure pumping system for an adjustable seating system in which an inflatable cell is provided to change the contour of the seat in response to changes in pressure therein and wherein a pump motor is continuously energized during inflation of the cell and is sized to stall when the inflatable cell reaches a predetermined pressure so as to prevent over pressurization of the air cell.

Yet another object of the present invention is to provide a low pressure system for inflating an air cell in an adjustable seat wherein a motor driven pump has its motor energized for reverse rotation to cause the pump to inflate or deflate the air cell. Reverse motor energization is controlled by a pneumatic switch which has a double pole, double throw switch coupled to a slide valve which has a neutral position in which air is directed from atmosphere to the pump when the double pole, double throw switch is positioned to energize the motor to rotate the pump to inflate the air cell; and a depressed bleed position when the motor is reversely energized to power exhaust the air cell.

These and other objects and advantages will be more apparent when reference is made to the following description and accompanying drawings.

BEST MODE OF CARRYING OUT THE INVENTION

Figure 1:
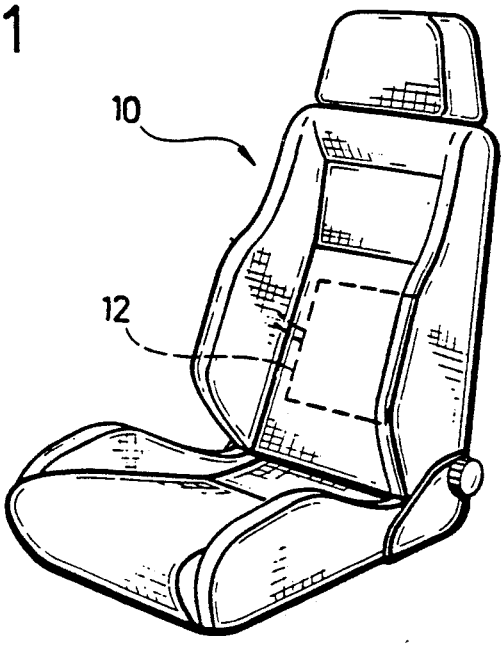
FIG. 1 is a perspective view of a vehicle seat embodying the invention.

Referring now to the drawings in greater detail, FIG. 1 illustrates an automotive single seat 10, having a low pressure pumping system 12 mounted therein for adjusting the back support of the seat.

The system 12 includes an air cell 14 having a capacity of less than 5 p.s.i., a reversible pump 16 driven by a motor 18, and a conduit 20 communicating between the pump and the air cell. Reversing mode type lead lines 22 are operatively connected between the motor 18 and pairs of contacts 24 and 26 of a two-position pneumatic switch 28 in a switch housing 30.

A normally closed bleed or exhaust valve 32 is mounted in the switch housing 30, operably connected to the contacts 26. A conduit 34 communicates between the bleed valve 32 and the pump 16.

In operation, when the contacts 24 of the switch 28 are manually engaged, the motor 18 is actuated via the lead lines 22 to drive the pump 16 so as to pump air through the conduit 20 to inflate the air cell 14 to a predetermined set pressure of less than 5 p.s.i., say, 3 p.s.i. Once this predetermined pressure is attained, the pump stops and the system is sealed by the normally closed bleed valve 32. As shown in FIG. 1, the motor energization continues but the pump output does not exceed the low pressure set pressure.

When it is desired to deflate the air cell 14, the contacts 26 of the switch 28 are manually engaged. This opens the bleed valve 32 and serves to reverse the polarity across the motor 18 to drive the pump 16 in the reverse direction. This power serves to bleed the system through the conduits 20 and 34 and the bleed valve 32. There is no need for a solenoid or relays in the system.

Figure 3:
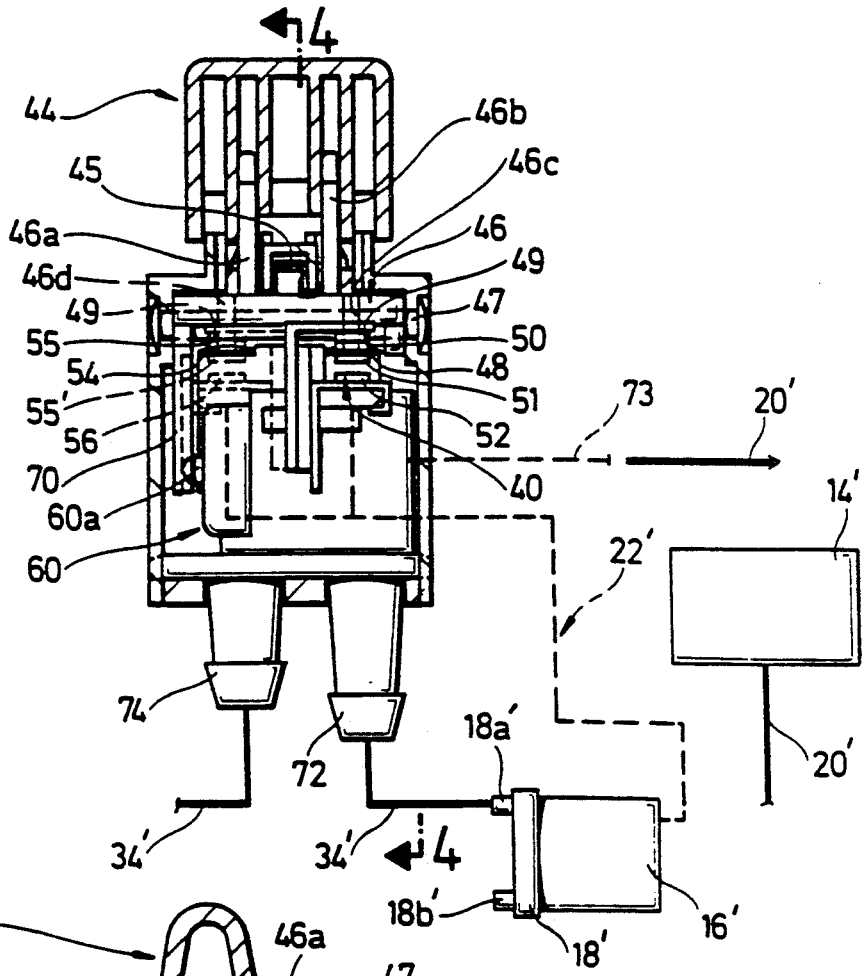
FIG. 3 is a sectional view of another embodiment of the invention for providing low pressure inflation of an air cell in an adjustable seat.
Figure 4:
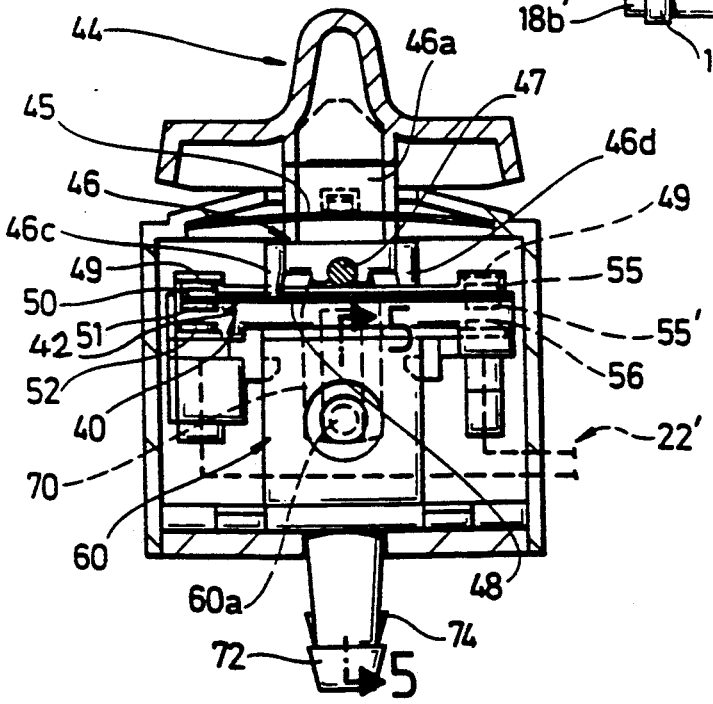
FIG. 4 is a sectional view taken along line 4—4 of FIG. 3.
Figure 5:
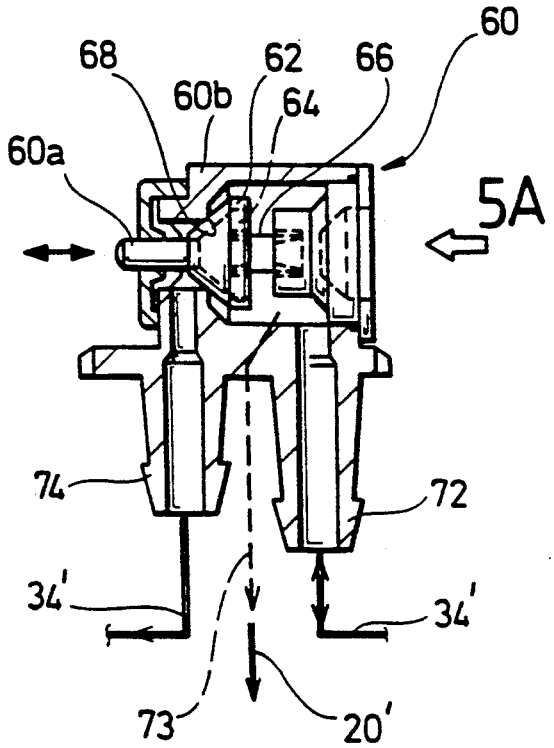
FIG. 5 is a sectional view taken along line 5—5 of FIG. 4.
Figure 5A:
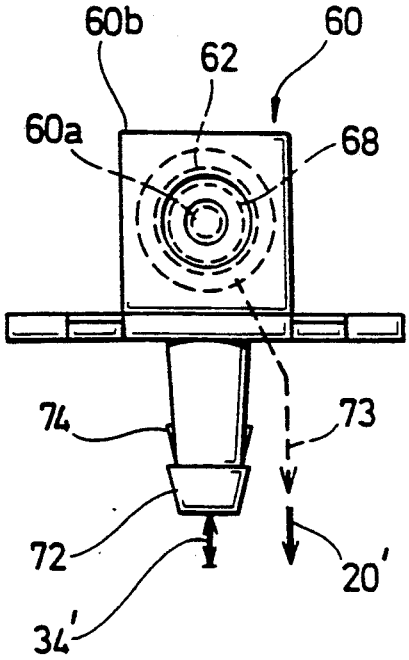
FIG. 5A is an elevational view looking in the direction of the arrow 5A in FIG. 5.
Figure 6:
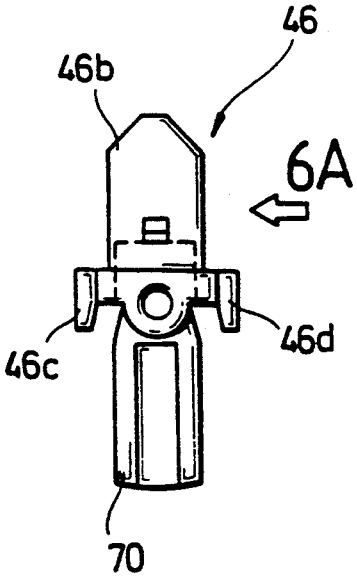
FIG. 6 is a side elevational view of an actuator.
Figure 6A:
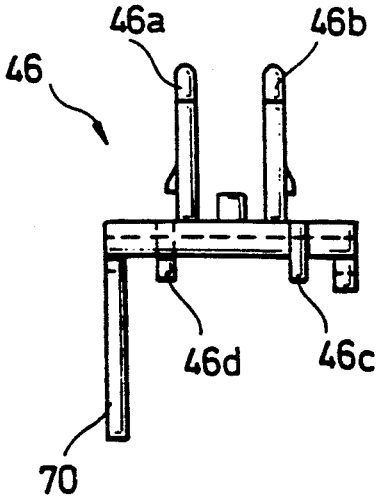
FIG. 6A is an elevational view looking in the direction of the arrow 6A in FIG. 6.

In the embodiment of the invention shown in FIG. 3, a two-position pneumatic switch 40 has a double pole, double throw switch 42 actuated by a pivotally mounted actuating rocker 44 centered in a neutral position by centering spring 45 and pivot on a pin 47. The actuating rocker 44 connects to an actuator 46 at tabs **46*a*, 46*b* thereon. The actuator 46 also includes switch actuating tabs 46*c*, 46*d*. Tab 46*c* engages a leaf spring 48 with contacts 50, 51 thereon. When depressed, contact 51 engages a fixed contact 52 as viewed in FIG. 4 and a leaf spring 54 with contact 55 thereon is positioned against a fixed contact 49 to cause mode reversing lines 22 to produce a polarity across a pump drive motor 18' to cause a pump 16' to be driven in a direction to discharge air through a conduit 20' to inflate an air cell 14'**.

When the low pressure inflation level of 3–5 p.s.i. is reached, the pressure in conduit 20' creates a load on the pump 16' which exceeds the output power from the drive motor 18'. At this point, the motor 18' is stalled such that the pressure in the air cell 14' does not exceed the 3–5 p.s.i. range.

Figure 2:
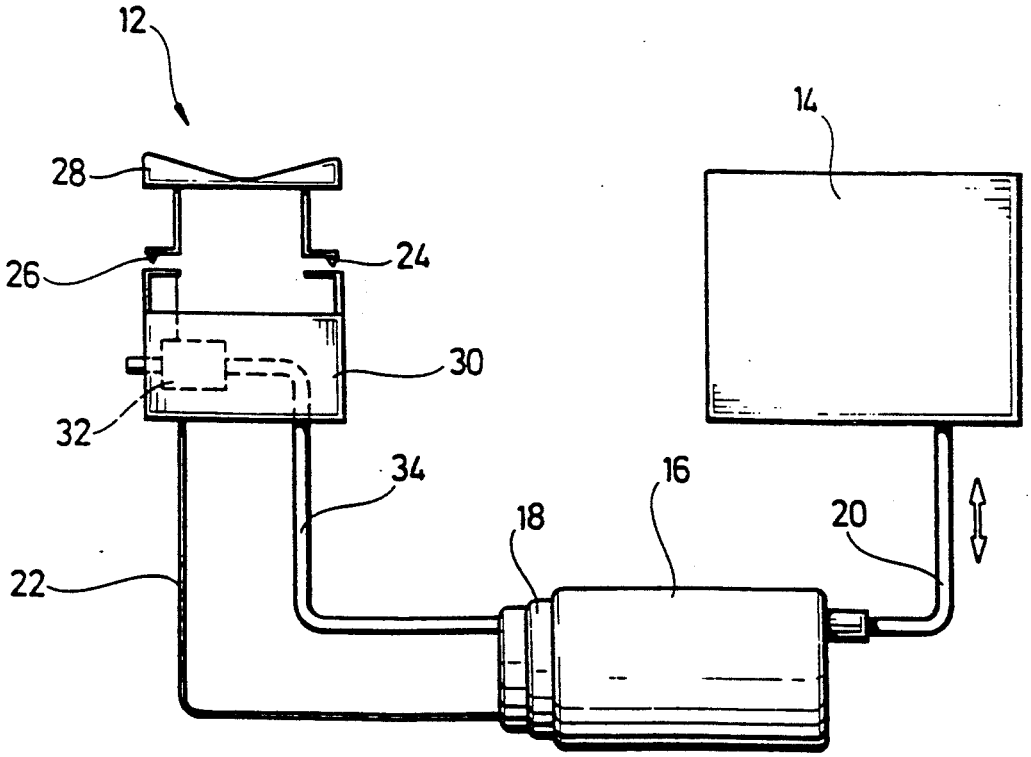
FIG. 2 is a diagrammatic layout of the inventive pumping system embodied in the seat structure of FIG. 1.

In either the embodiment of FIGS. 1–2 or in the embodiment of FIGS. 3–6, there is no limit switch in the conduit (20, 20') or in the air cell (14,14') for sensing the pressure to prevent over pressurization as in the case of systems in which the pump does not stop when a low pressure level is attained. In such prior art cases, the motor pump capacity could cause over inflation unless the motor power was cut off by a pressure limit switch.

The leaf spring 54 has a contact 55 which closes against fixed contact 56 to reverse the polarity across the drive motor 18' when the actuating lever is position clockwise as shown in FIG. 3 to a deflation position. At the same time, leaf spring 48 is positioned with its contact 50 against contact 49 to reverse the polarity across drive motor 18'. The pump 16' is reversed to power deflate the air cell 14' by drawing air therefrom, thence through conduit 20' and through conduit 34' to valve housing 30', thence to atmosphere.

In order to provide for air flow through valve housing 30' during power inflation and power deflation, a slide valve 60 is provided. Valve 60 includes a seal cap 62, a poppet seal 64 and a spring 66. The spring 66 normally biases poppet seal 64 closed against a seal seat 68 when the actuating rocker 44 is centered by centering spring 45. In a neutral centered position, the rocker 44 positions actuator 46 so that an arm 70 thereon positions a valve stem **60*a* to close poppet seal 64 on a valve seat 68. Thus, the continuously operating pump draws air from pump fitting 18*b*; fitting 72 connected by conduit 34' to the pump outlet 18*a'* through fitting 74 to outlet 73, thence through conduit 20'. When the pressure in air cell 14' reaches a predetermined low pressure, e.g., 3 p.s.i., the pump 18'** dead heads. Once the pump reaches a dead head position (the impeller is either stopped or moving at a low speed), backflow is prevented by the pump motor pressure on the pump vanes.

During deflation, actuator 46 is rotated to an arm 70 thereon to move a valve stem **60*a* inboard of a housing 60*b* of the slide valve 60. This opens the poppet seal 64 from seat 68 and air is discharged from the air cell 14' for exhaust through conduit 20' and fitting 73, thence through the open poppet seal 64 to fitting 72 into the pump casing through a branch of conduit 84', where the exhaust power bleeds to atmosphere through fitting 18*b***.

Figure 7:
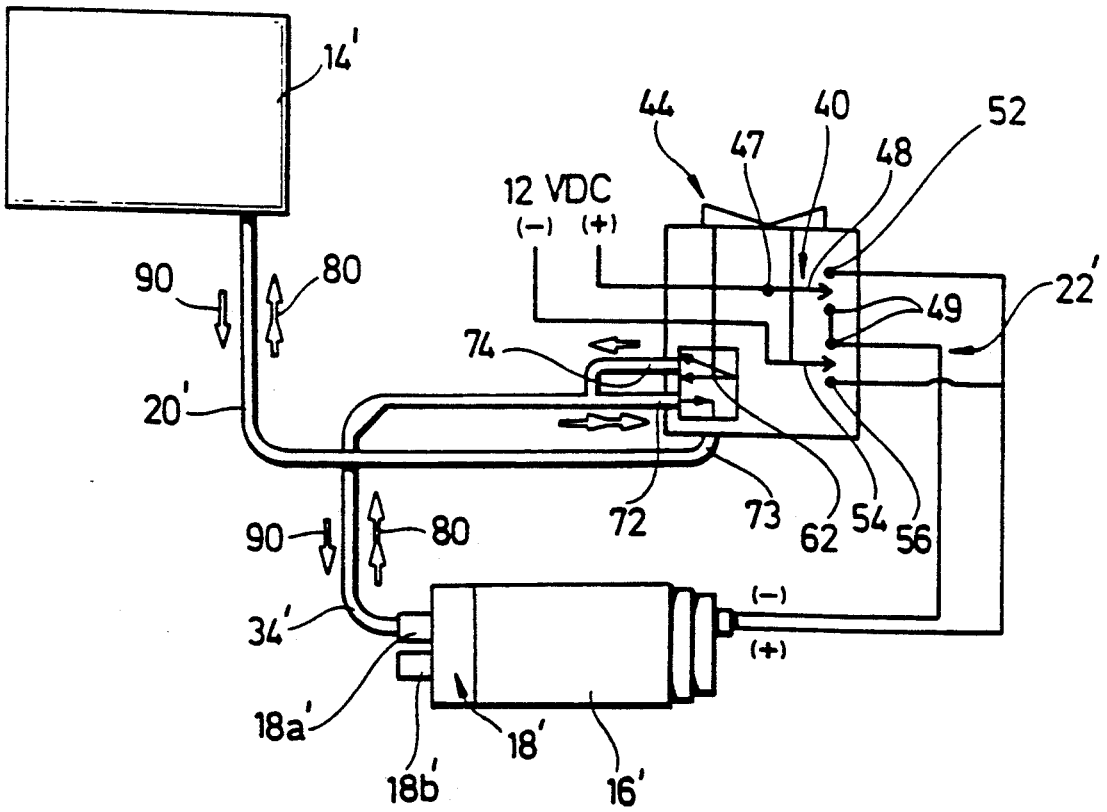
FIG. 7 is a diagrammatic view of the inflation and deflation modes in the embodiment of FIG. 3.

Diagrammatic representations of the aforesaid inflation and exhaust flow paths are shown in FIG. 7, which shows the inflation path with double arrow lines 80 and the exhaust path with single arrow lines 90.

INDUSTRIAL APPLICABILITY

It should be apparent that the invention provides a compact and efficient low pressure pumping arrangement having a minimum number of system components for inflating and deflating an air cell mounted in the lumbar region of a seat, such as a vehicle seat, for maximum riding comfort and desired support.

While but one embodiment of the invention has been shown and described, other modifications are possible within the scope of the following claims.

The embodiments of the invention in which an exclusive property or privilege is claimed are defined as follows:

1. A system for controlling the pneumatic pressure in an air adjustable seat having a generally horizontal seat portion and a back portion extending generally upwardly from the horizontal seat portion for support of a human in a seated position thereon comprising in combination an air cell operatively mounted within said seat and pneumatically inflatable to a predetermined pressure to provide cushioned support for a human seated in said seat, air pump means for supplying pressure air to said air cell, conduit means communicating said pump means to said air cell, selectively energizable motor means operatively connected to said pump means for driving said pump means to a stall point at which the pressure in said air cell matches the maximum pressure generated by said motor in driving said pump means in a first direction so that said pressure in said air cell is maintained at said predetermined pressure and said motor responding to any drop in said predetermined pressure to drive said pump means in said first direction to increase said pressure in said air cell to said predetermined pressure.

2. The pressure system described in claim 1, wherein said motor means is a reversible electrically energizable motor, a manually operable two position switch for reversing said motor means and thereby the direction of said pump means, a normally closed bleed valve adapted to be opened at one position of said two position switch, and a second conduit communicating between said pump means and said bleed valve, said switch adapted to actuate said motor and pump in one direction to fill said air cell via said first conduit, and to reverse said motor and pump to power bleed said air cell via said first and second conduits and said bleed valve.

3. The pressure system described in claim 1, wherein said motor means is a reversible motor and a two position switch is associated with said motor for controlling the motor selectively to control the direction of flow to and from said air cell.

4. The pressure system described in claim 1, said motor means is a reversible electric motor which has a output power to drive said pump to produce a low output pressure said reversible electric motor having a stall speed which limits the output of said pump when said air cell reaches said predetermined low output pressure.

5. The system described in claim 1, and further including a two position, double pole, double throw switch, said system having a normally closed bleed valve responsive to operation of said two position switch in an inflation mode to provide flow of air from atmosphere to said pump and responsive to operation of said two position switch in an deflation mode to provide air flow from said air cell and pump to the atmosphere.

* * * * *